US007017959B2

(12) United States Patent
Selness

(10) Patent No.: US 7,017,959 B2
(45) Date of Patent: Mar. 28, 2006

(54) PORTABLE SECURITY DEVICE FOR DOORS

(76) Inventor: Jerry N. Selness, 4611 Monongahela St., San Diego, CA (US) 92117

( * ) Notice: Subject to any disclaimer, the term of this patent is extended or adjusted under 35 U.S.C. 154(b) by 0 days.

(21) Appl. No.: 10/754,791

(22) Filed: Jan. 8, 2004

(65) Prior Publication Data

US 2004/0140679 A1 Jul. 22, 2004

Related U.S. Application Data

(60) Provisional application No. 60/439,095, filed on Jan. 8, 2003.

(51) Int. Cl.
*E05C 19/18* (2006.01)

(52) U.S. Cl. ..... 292/293; 292/292

(58) Field of Classification Search ..... 292/290, 292/291, 292, 293, 297, 343
See application file for complete search history.

(56) References Cited

U.S. PATENT DOCUMENTS

| | | | | |
|---|---|---|---|---|
| 358,278 | A * | 2/1887 | Kirchner et al. | 292/293 |
| 750,692 | A * | 1/1904 | Poenitz | 292/297 |
| 898,685 | A * | 9/1908 | Ritter | 292/291 |
| 1,119,650 | A * | 12/1914 | Simth | 292/343 |
| 4,082,335 | A | 4/1978 | Smith | |
| 5,291,760 | A | 3/1994 | Schrader | |
| 5,360,245 | A | 11/1994 | David et al. | |
| 5,542,723 | A | 8/1996 | Scharf | |
| 5,556,143 | A | 9/1996 | Robinson | |
| 5,572,768 | A | 11/1996 | Daul | |
| 5,581,948 | A | 12/1996 | Simonsen | |
| 5,582,447 | A | 12/1996 | Leon et al. | |
| 5,590,928 | A | 1/1997 | Voiculescu | |
| 5,605,364 | A | 2/1997 | Shelledy | |
| 5,836,628 | A | 11/1998 | Beier | |
| 5,845,433 | A | 12/1998 | Walsh | |
| 6,076,866 | A | 6/2000 | Prevot et al. | |
| 6,149,212 | A | 11/2000 | Kuntz et al. | |
| 6,176,882 | B1 * | 1/2001 | Biedermann et al. | 623/17.15 |
| 6,244,581 | B1 | 6/2001 | Arnhold | |
| 6,317,922 | B1 | 11/2001 | Kondratuk | |
| 6,318,137 | B1 | 11/2001 | Chaum | |

* cited by examiner

*Primary Examiner*—Gary Estremsky

(57) ABSTRACT

A portable door locking device. In one embodiment, a door lock may include a base plate configured with a locking wedge and a driver wedge. The base plate may be formed in a U-shaped fashion, thus defining a cut-out region sized to receive the locking and driver wedges. Typically, the locking wedge is pivotally attached to the base plate, permitting rotational movement of the locking wedge about a pivoting axis. In some implementations, the locking wedge comprises a sloped bottom surface that slideably cooperates with a sloped top surface of the driving wedge. In use, the driver wedge may be driven in linear fashion underneath the locking wedge, causing the locking wedge to engage an adjacent door. With the door lock deployed in this manner, the door cannot be readily opened from the outside.

13 Claims, 8 Drawing Sheets

PORTABLE SECURITY DEVICE FOR DOORS

CROSS-REFERENCE TO RELATED APPLICATION

This application claims the benefit of U.S. Provisional Application No. 60/439,095, filed 8 Jan. 2003.

BACKGROUND OF THE INVENTION

1. Field of the Invention

The present invention relates generally to door security devices, and in particular, to portable door locking devices.

2. Description of the Related Art

It is often necessary or desirable for a person to be able to ensure their safety and privacy by locking doors. This is especially true when, for example, a person is traveling and must stay in a hotel, motel, or other similar temporary accommodation. Many establishments provide interior security devices such as keyed and keyless entry locks, dead bolts, and door security chains which may be secured from within the room by a patron or guest. Although these security devices may provide a particular level of security in some instances, additional levels of security against unauthorized entry is commonly desired.

Assorted security devices have been developed to supplement or replace existing door security devices. Many existing security devices are expensive, and in some cases, complex to install and remove. Moreover, some security devices require permanent installation and therefore are not capable of being readily utilized by travelers who frequently move from one location to another.

While there have been attempts to provide low-cost, effective, portable door locking devices that can be easily implemented, these attempts have not been entirely successful. In view of the foregoing, a present need exists for an improved door locking device.

SUMMARY OF THE INVENTION

Broadly speaking, the present invention, as set forth in various embodiments, constitutes apparatus for tightly wedging a door in its frame, thereby making it very difficult to force open. This wedging effect does not permit any "play" when a door is closed, adding to the unlikelihood that the door can be jiggled in a manner that can facilitate unauthorized entry.

The door lock of the invention includes, in one embodiment, a base plate configured with a locking wedge and a driver wedge. The base plate may be formed in a U-shaped fashion, thus defining a cut-out region sized to receive the locking and driver wedges. Typically, the locking wedge is pivotally attached to the base plate, permitting rotational movement of the locking wedge about a pivoting axis. In some implementations, the locking wedge comprises a sloped bottom surface that slideably cooperates with a sloped top surface of the driving wedge. In use, the driver wedge may be driven in a linear fashion underneath the locking wedge, causing the locking wedge to engage an adjacent door. With the door lock deployed in this manner, the door cannot be readily opened from the outside.

In accordance with one aspect of the present invention, any of a variety of different mechanisms may be used to drive the driver wedge underneath the locking wedge. Possible driving mechanisms include, for example, manually operated hand screws, electrical motors, hydraulic pumps, cam levers, and other similar drive mechanisms.

In accordance with another aspect of the present invention, an alarm device may be incorporated with the door lock to detect and signal movement or attempted forced entry.

BRIEF DESCRIPTION OF THE DRAWING

These and other aspects, features and advantages of the present invention will become more apparent upon consideration of the following description of preferred embodiments taken in conjunction with the accompanying drawing, in which.

DETAILED DESCRIPTION OF THE PREFERRED EMBODIMENTS

In the following description of preferred embodiments, reference is made to the accompanying drawings, which form a part hereof, and which show by way of illustration, specific embodiments of the invention. It is to be understood by those of working skill in this technological field that other embodiments may be utilized, and structural, electrical, as well as procedural changes may be made without departing from the scope of the present invention.

Each embodiment of the invention described herein is useful in securing a door that swings on one or more hinges from an open position to a closed position in which the edge of the door opposite its hinged side is adjacent to a door jam with a clearance gap therebetween. As used herein, the term "door gap" denotes the clearance gap between a non-hinged side of a door and the adjacent door jam.

Figure 1A:
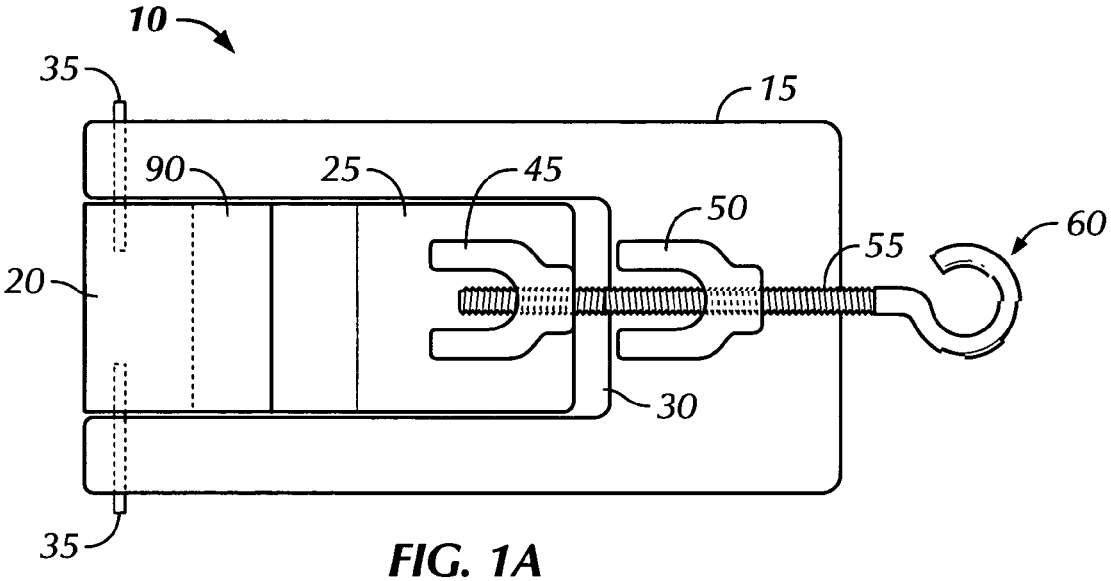
FIGS. 1A and 1B are top and side views, respectively, of one embodiment of the present invention.
Figure 1B:
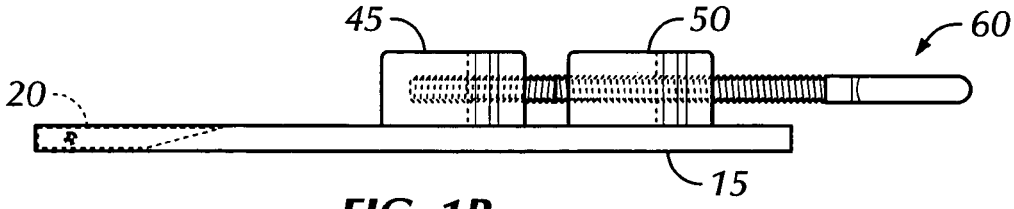

FIGS. 1A and 1B are top and side views, respectively, of one embodiment of the present invention. As shown, door lock 10 generally includes base plate 15 configured with locking wedge 20 and driver wedge 25. Base plate 15 may be formed in a U-shaped fashion, thus defining cut-out region 30 sized to receive the locking and driver wedges. As shown here, the door lock of the invention is in its engaging, or locking configuration.

In some embodiments, locking wedge 20 may be pivotally attached to base plate 15 using, for example, pivot pins 35. However, the invention is not so limited and alternative attachment designs for securing locking wedge 20 to base plate 15 are possible. For example, the locking wedge may be configured with a living hinge (not shown), in lieu of the illustrated pivot pins 35.

Appropriate positioning of pivot pins 35 relative to the locking wedge and the base plate permits rotational movement of the locking wedge about an axis defined by the pivot pins. Typically, locking wedge 20 comprises sloped top surface 90 that slopes downward toward opposing driver wedge 25.

Driver wedge 25 is typically formed so that this wedge slideably cooperates with locking wedge 20. Threaded blocks 45 and 50 are shown respectively mounted on driver wedge 25 and base plate 15. Blocks 45 and 50 generally include threaded tooling to accommodate threaded shaft 55 of hand screw 60. Although hand screw 60 is shown with a curved eye-hook configuration, it is contemplated herein that hand screw 60 may be any other configuration, such as a knurled cap or knob, as long as it allows sufficient turning of threaded shaft 55.

Driving and retracting the driver wedge in accordance with this embodiment may be accomplished as follows. Initially, driver wedge 25 is in a retracted position relative to base plate 15. At this point, door lock 10 may be appropriately placed within the door gap. Next, a user may manually manipulate hand screw 60, thereby driving driver wedge 25 underneath locking wedge 20. As driver wedge 25 moves up along sloped top surface 90, more and more pressure is applied to locking wedge 20 and the door and door frame. With the door lock deployed in this fashion, the associated door cannot be readily opened from the outside, thus providing the occupant of the room with a heightened level of security from unauthorized entry.

Retracting driver wedge 25 from its wedged position relative to locking wedge 20 may be accomplished in a similar, but reverse, manner. For example, a user may again manipulate hand screw 60, but this time in a reverse direction. This causes a retraction of the driver wedge with respect to the locking wedge. The retracted door lock may then be removed from its position within the door gap.

Figure 2A:
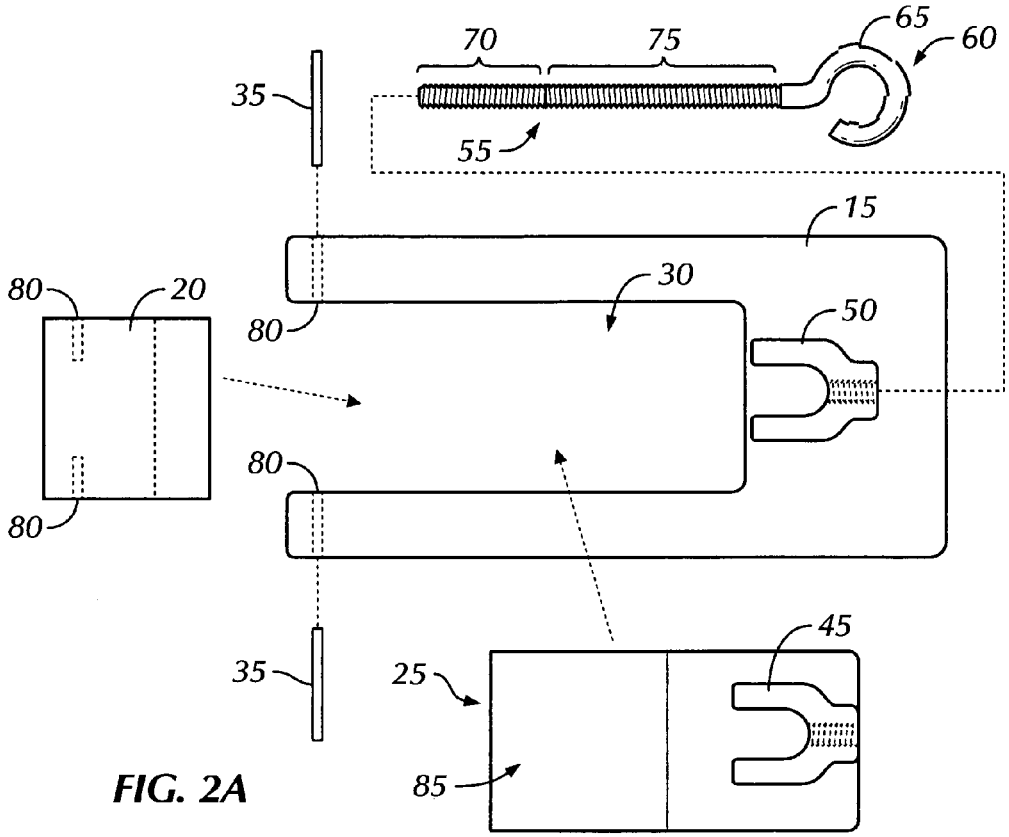
FIGS. 2A and 2B are top and side views, respectively, of a disassembled door lock.
Figure 2B:
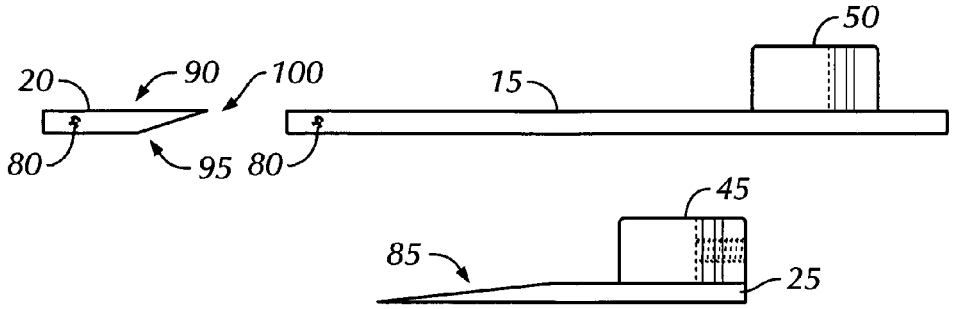

FIGS. 2A and 2B are top and side views, respectively, of disassembled door lock 10. Specifically, FIG. 2A depicts hand screw 60 having turn handle 65 attached to threaded shaft 55. In some embodiments, the threaded shaft 55 may include distal and proximal threaded regions 70 and 75 in the form of a double-acting, reverse threaded screw. The distal and proximal threaded regions comprise opposing thread designs such that distal threaded region 70 may be fabricated with left-hand threading, while proximal threaded region 75 comprises right-hand threading (or vice versa). Opposing thread designs may be used for the distal and proximal threaded regions to facilitate the linear translation of driver wedge 25 relative to base plate 15, as may be required during the driving or retraction of the driver wedge. By employing this dual threaded design, the driver wedge moves faster and farther per turn of the threaded shaft.

FIG. 2A also shows an unobstructed view of cut out region 30 of base plate 15. Pin cavities 80, shown in dashed lines, may be formed near the U-shaped end of the base plate, with corresponding pin cavities 80 formed in locking wedge 20. In some embodiments, pivot pins 35 may be used to pivotably connect the locking wedge to the base plate. As contemplated herein, pin cavities may include slots, grooves, or the like.

FIG. 2B shows locking wedge 20 having sloped top surface 90 and partially sloped bottom surface 95. Specifically, the sloped top surface of the locking wedge is shown formed with a predefined slope that spans substantially the entire length of the wedge. Bottom surface 95 of the locking wedge, on the other hand, may be substantially flat for the majority of the surface length, but includes a distinct upward slope near interfacing edge 100.

FIG. 2B further shows driver wedge 25 having a partially sloped top surface 85. Notably, the slope of surface 85 complements sloped bottom surface 95 of the locking wedge, thus facilitating smooth cooperation between the locking and driver wedges during operation. While specific examples of top and bottom sloping surfaces have been shown and described, it is to be understood that the invention is not limited to any particular amount or degree of slope for these structures and that almost any design configuration may be used as long as the interfacing devices (that is, locking and driving wedges 20, 25) include cooperating surfaces.

Figure 5A:
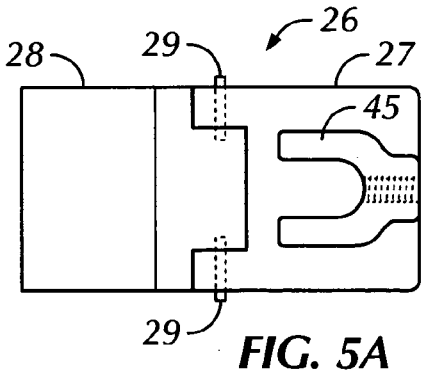
FIGS. 5A and 5B are top and side views, respectively, of an alternative embodiment of the door lock of FIG. 1.
Figure 5B:
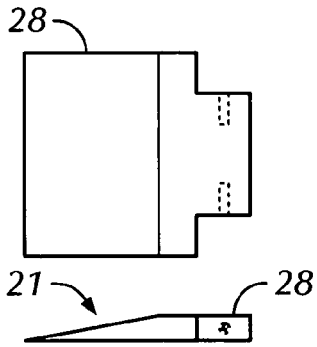

In many embodiments, driver wedge 25 may be formed as a solid rigid structure, but other structural designs are possible. For example, as shown in FIG. 5A, the driver wedge may be constructed using two distinct driver wedge components that are pivotably attached to each other. In this embodiment, driver wedge 26 is formed of driver plate 27 and driver wedge 28 pivotably coupled thereto by pivot pins 29. Threaded block 45 is shown mounted to element 27. FIG. 5B shows driver wedge 28 in a top and side view. Sloped surface 21 of driver wedge 28 is shown. The two-piece driver wedge design can be implemented to enhance the engagement of the locking and driver wedges as well as to increase the overall engagement of the door lock within a door gap.

The individual components comprising the door lock of the invention may be fabricated using any of a variety of rigid materials including plastic, carbon fiber plastic composites, wood, metal, alloys, and the like. Each door lock embodiment of the invention may also be fabricated in a variety of different sizes to meet a particular need. The only dimensional characteristic required by the invention is that some or all of the locking and driving wedges must be of an appropriate size so that these components can be inserted into the door gap region of a door and adjacent door jam.

Figure 3:
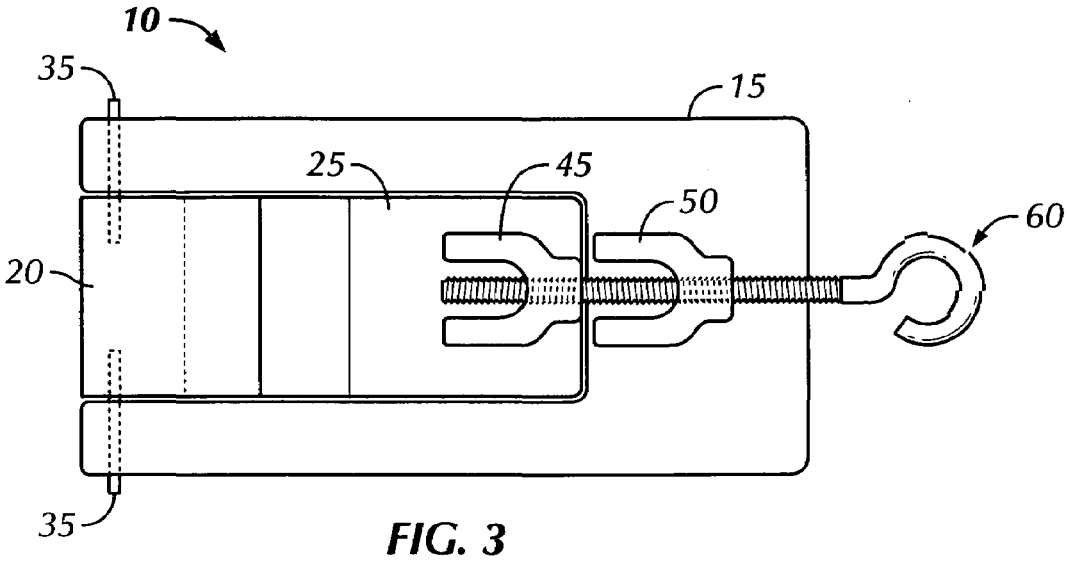
FIG. 3 is a top view of a door lock in a retracted configuration.

FIG. 3 is a top view of door lock 10 in a retracted configuration. The retracted configuration is typical of the door lock device of the invention prior to insertion into a door gap, and contrasts the engaged configuration shown in FIGS. 1A and 1B. A primary distinction between the engaged and retracted configurations relates to the relative positioning of the locking and driving wedges.

For example, in FIG. 3, threaded block 50 of base plate 15 is in close spatial relationship to threaded block 45 of driving wedge 25. Noticeably, all (or substantially all) of locking wedge 20 is recessed within cutout region 30 of the base plate, while substantially the entire cutout region is occupied by the locking and driving wedges.

In contrast, the engaged configuration of FIGS. 1A and 1B show threaded block 50 of base plate 15 a distinct distance from threaded block 45 of driving wedge 25. In this configuration, a portion of cutout region 30 is exposed, while a portion of driving wedge 25 has been driven under locking wedge 20. Wedging driving block 25 beneath locking wedge 20 forces the locking wedge to axially pivot in an upward manner. In use, the upward pivoting force of the locking wedge causes the top surface of that wedge to engage an adjacent door, while the bottom surface of driving wedge 25 engages an adjacent door jam (or vice versa). Once deployed, the locking and driving wedges effectively bridge the door gap, thus preventing or inhibiting unauthorized opening of the door.

Figure 4A:
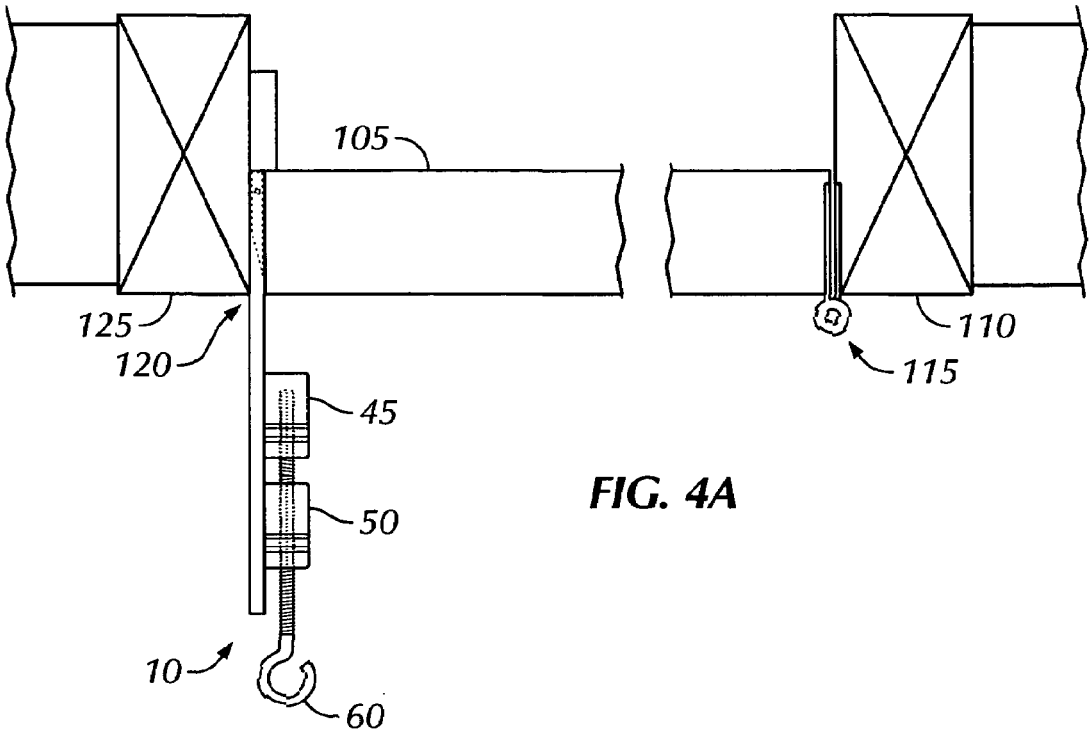
FIG. 4A is a top view of the door lock of FIG. 1 in place in a door gap.
Figure 4B:
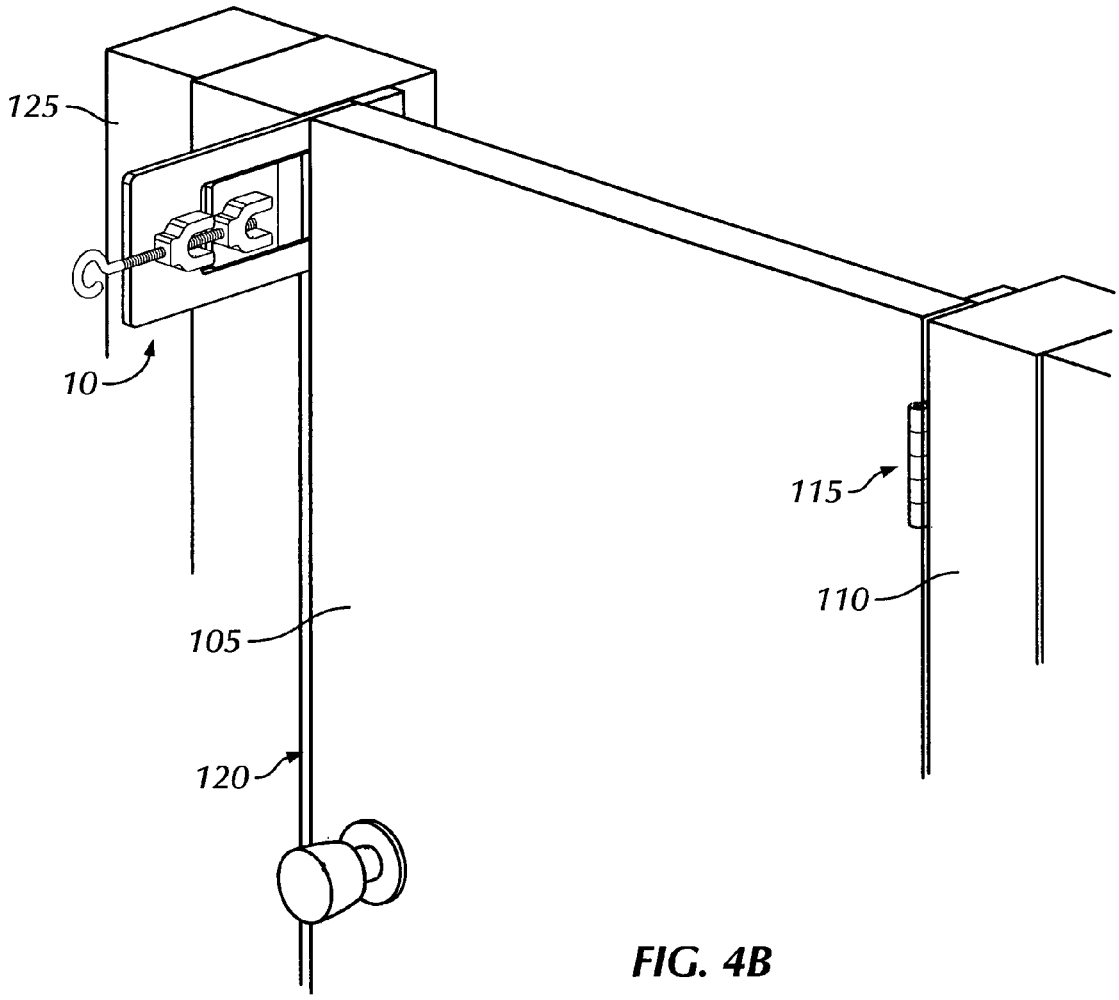
FIG. 4B is a partial perspective view of the door lock in place as in FIG. 4A.

FIGS. 4A and 4B are top and perspective views, respectively, of one implementation of the invention. As shown, door 105 is attached to door jam 110 using hinge 115. The door is in the closed position, thus creating gap 120 between door 105 and door jam 125.

Door lock 10 is shown inserted into gap 120. The door lock 10 is in the engaged configuration such that the driving wedge has been driven under the locking wedge, causing the locking wedge to engage the outer portion of door 105 and in some cases, causing the driving wedge to engage the outer portion of door jam 125 (as described above). When in the locking position, as shown in FIG. 4B, the lock of the invention effectively fills and closes a portion of gap 120 so that the door cannot rotate through its normal hinged radius.

If any unauthorized person attempts to open the door, any inward movement of the door will be hindered or prevented because of the placement of door lock 10 within gap 120. The door lock is shown deployed near the top portion of the door and at the approximate height of opposing top hinge 115. Deploying the door lock opposite the top hinge may maximize the effectiveness of door lock 10, but the door lock may be placed at nearly any location along gap 120.

To allow opening of door 105, the user simply rotates hand screw 60 in the appropriate direction, causing the locking and driving wedges to at least partially disengage. Once disengaged, the door lock may be removed from the door gap and the door can be easily opened. Since door lock 10 does not require permanent attachment to the door or door jam, the door lock may be quickly installed or removed as may be desired. In addition, it is completely portable, and can be taken by the user while travelling, for example.

The present invention has been described being implemented using a manually operated hand screw. However, alternative configurations are possible and within the contemplation of the present invention. For example, the door lock of the invention may be implemented using other types of driving mechanisms such as electric motors, hydraulic pumps, cam levers, and other appropriate drive mechanisms. Still further possibilities include the incorporation of an alarm system with any of the door lock embodiments described herein. Alternative embodiments of the invention, some of which incorporate the just-described features, will now be described.

Figure 6:
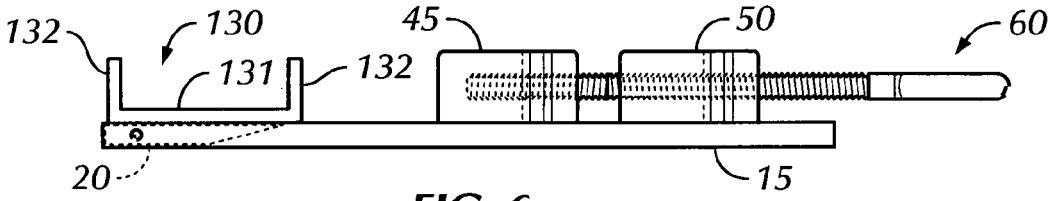
FIG. 6 is a side view of an alternative embodiment of the present invention.

The base plate has been shown having a substantially planar surface relative to the U-shaped cutout region 30. However, other designs are possible where, for example, a protrusion plate or hooking member may be affixed to either side of base plate 15 to augment the effectiveness of the door lock. With reference to FIG. 6, protrusion plate 130, having base 131 and sides or wings 132, may be employed to enclose a portion of the edge of the door and provide even more positive engagement of the door lock device of the invention between the door and the door jam.

Figure 7A:
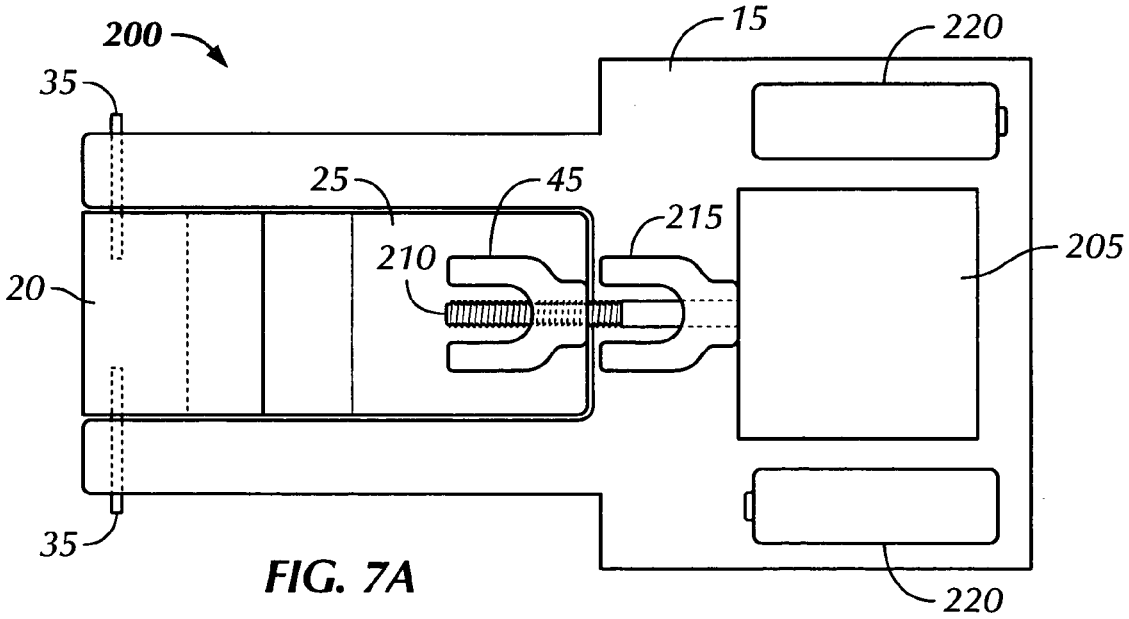
FIGS. 7A–7C are top, side and end views, respectively, of another alternative embodiment of the present invention.
Figure 7B:
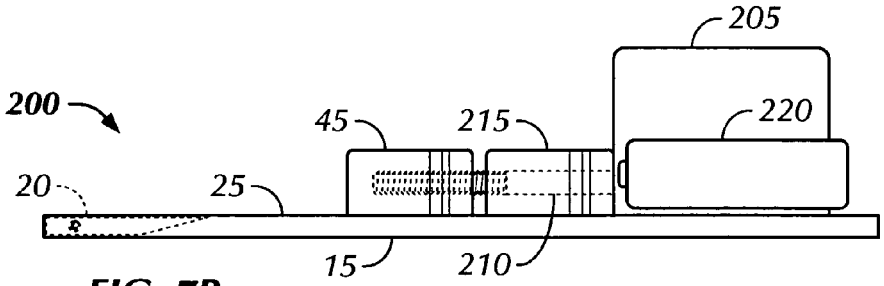
Figure 7C:
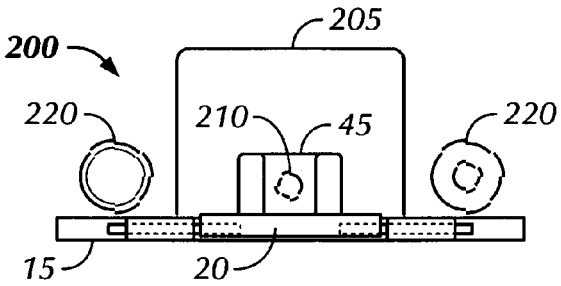

FIGS. 7A–7C are top, side, and end views, respectively, of an alternative embodiment of the present invention. Similar to other door lock embodiments, door lock 200 may include base plate 15 configured with locking and driver wedges 20 and 25. However, in the illustrated embodiment, electric motor 205 is attached to the base plate and provides the necessary driving force to linearly move driver wedge 25 beneath locking wedge 20.

Motor 205 provides the necessary driving force to driver wedge 25 using, for example, threaded drive shaft 210. The drive shaft 210 is shown projecting from motor 205, passing through the drive shaft guide 215, and ultimately threading through block 45 of driver wedge 25. In contrast to the dual-threading design utilized in some of the other embodiments, drive shaft 210 may be configured with threading formed in a single direction, in cooperation with the threading of block 45.

Drive shaft guide 215 may be formed with a cylindrical cavity that substantially conforms to the diameter of drive shaft 210, while permitting the drive shaft to slide or pass through guide 215 as may be required. Typically, the cylindrical cavity of the drive shaft guide is void of any threading and may be designed with a relatively smooth surface to facilitate cooperation with and to provide support for rotating drive shaft 210. It is to be understood that while the drive shaft guide 215 may be useful in many implementations, it is not essential or critical to this embodiment of the invention.

Electric motor 205 and associated battery power sources 220 may be implemented using any suitable motor and power supply technologies well known to those skilled in the art. The motor is shown having two batteries 220 (for example, AAA, AA, C, D, 9V, among others), but the invention is not so limited and any suitable electrical source that sufficiently powers the motor may be used. In addition, electric motor 205 may be configured to facilitate remote operation.

Motor 205 is typically configured with forward and reverse capabilities. When the motor is operated in the forward direction, it rotates drive shaft 210, causing driver wedge 25 to be driven underneath locking wedge 20. In contrast, when the motor in operated in the reverse direction, it rotates the drive shaft in the opposite direction, retracting the driver wedge from its wedged positioning relative to the locking wedge.

It may be possible that the drive shaft itself is linearly movable with respect to the motor. In such case, the end of the drive shaft could be journaled in block 45 and threaded in block 215. As a further alternative, the drive shaft coupled to motor 205 could be dual reverse threaded, as in the FIG. 1 embodiment, so it would be threaded through both blocks and move linearly with respect to the motor.

Figure 8:
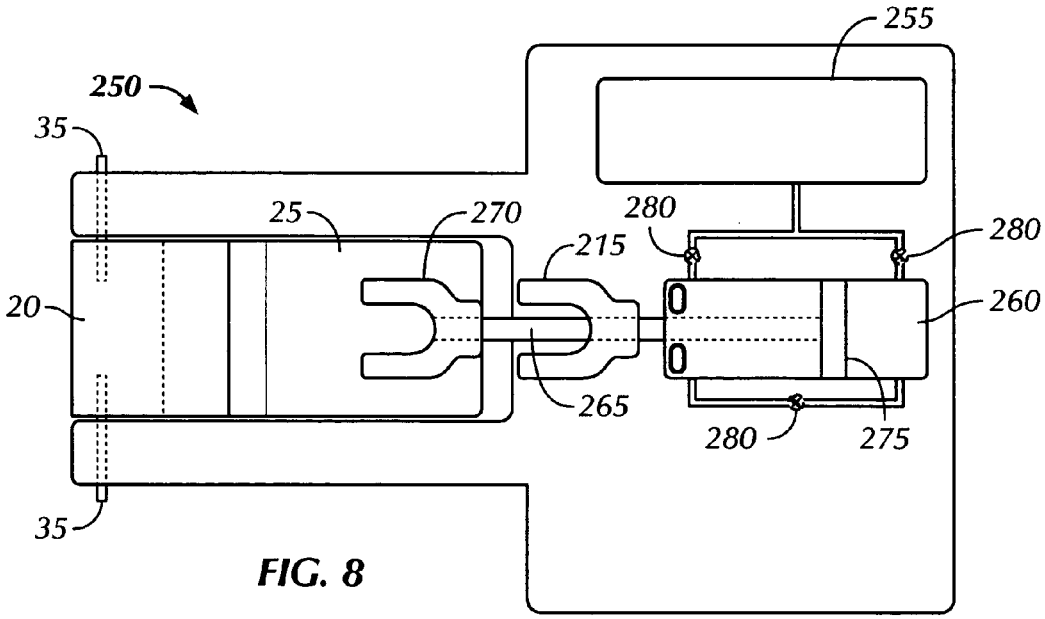
FIG. 8 is a top view of yet another alternative embodiment of the present invention.

FIG. 8 is a top view of an alternative embodiment of the present invention. In accordance with this embodiment, hydraulic pump 255 is implemented for driving and retracting driver wedge 25.

As shown, door lock 250 includes base plate 15 configured with hydraulic pump 255 in communication with a hydraulic cylinder 260. The hydraulic cylinder is shown configured with a drive shaft 265 projecting from the cylinder and passing through a drive shaft guide 215. Block 270 may be rigidly attached to driver wedge 25 and sized to receive the distal end of drive shaft 265. The distal end of the drive shaft may be attached to block 270 using any suitable method (for example, adhesives, solder, metal welds, among others) that permits block 270 and drive shaft 265 to remain in a fixed spatial relationship during operation. The shaft and block may also be so coupled as to enable wedge 25 to tilt as it engages wedge 20, if desired.

The optional drive shaft guide 215 may be utilized to facilitate the driving and retraction of drive shaft 265, and in some instances, provides physical support to the drive shaft. Again, while drive shaft guide 215 may be useful in many implementations, it is not an essential or critical feature.

Hydraulic pump 255 and associated cylinder 260 may be implemented using any suitable design and configuration that can provide the necessary driving and retracting requirements in accordance with the invention. Driving and retracting driver wedge 25 in accordance with this embodiment may be accomplished as follows. Initially, driver block 25 may be in a retracted position relative to base plate 15, while drive shaft 265 and piston 275 are positioned to the rear of the hydraulic cylinder. At this point, the door lock may be appropriately placed into the door gap. Next, the hydraulic pump 255 may be energized or switched into a driving mode that causes hydraulic fluid to flow from pump 255 to the rear of cylinder 260. Fluid flow may be controlled using, for example, hydraulic valves 280. Consequently, piston 275 is forced from the rear of the cylinder, thereby driving driver wedge 25 underneath locking wedge 20.

Retracting driver wedge 25 from its wedged position relative to locking wedge 20 may be accomplished by in a similar, but reverse, manner. For example, the hydraulic pump may be placed into a retracting mode that causes hydraulic fluid to flow from the rear of the cylinder and back into pump 255. This causes the piston to be forced to the rear of cylinder 260, thereby retracting the driver wedge. The retracted door lock may then be removed from its position within the door gap.

Figure 9A:
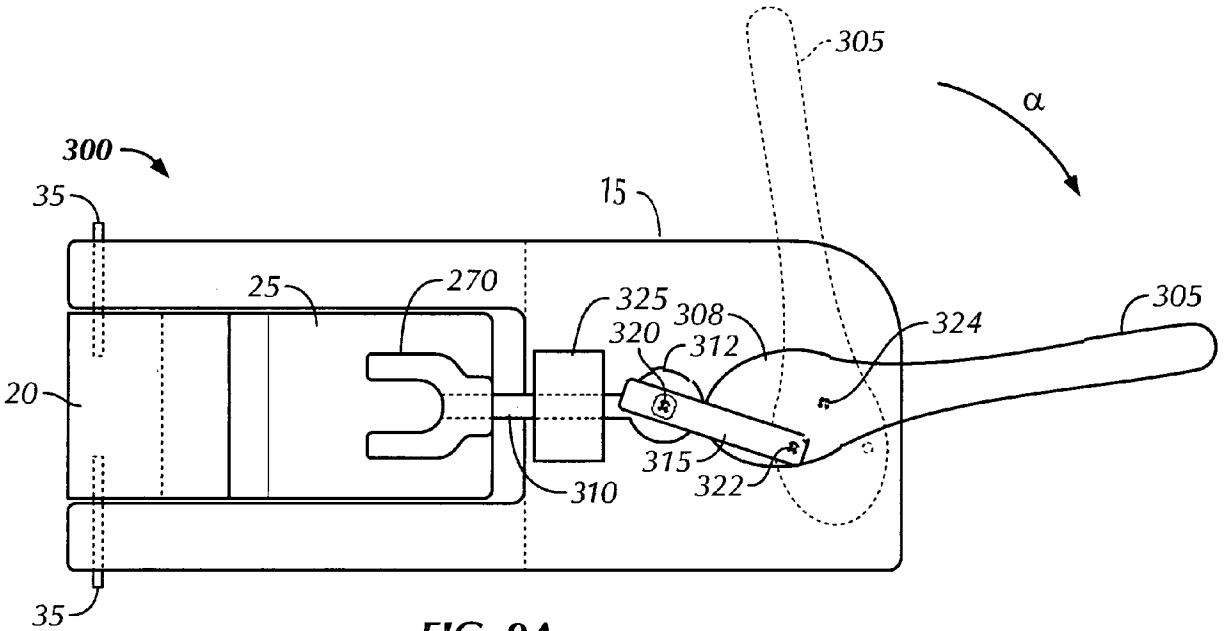
FIGS. 9A–9B are top and side views, respectively, of a door lock of the invention configured with a locking arm.
Figure 9B:
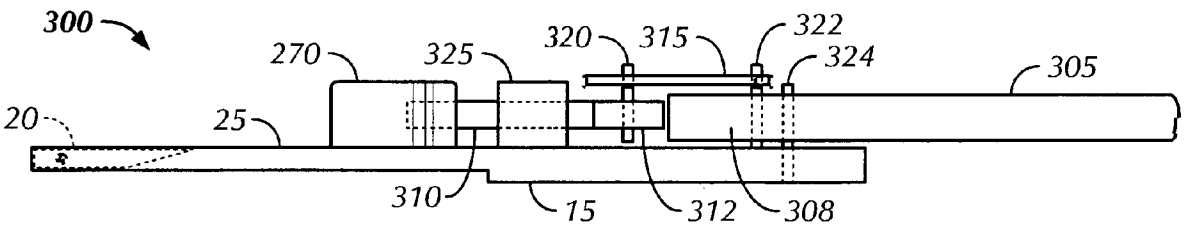

FIGS. 9A and 9B are top and side views, respectively, of another alternative embodiment of the present invention. In accordance with this embodiment, a hand lever mechanism is implemented for driving and retracting the driver wedge.

As shown, door lock 300 includes the base plate 15 configured with an over-center cam hand lever 305 coupled to drive shaft 310. Link plate 315 and associated pivot pins 320 and 322 are shown connecting hand lever 305 and drive shaft 310. The drive shaft is shown passing through slider bearing block 325 in such a manner that the distal end of the drive shaft is attached to block 270. It is typically desirable for block 270 and drive shaft 310 to be attached in such a manner that they remain in a linearly fixed relative relationship during operation. Driveshaft 310 may have enlarged circular end portion 312 providing strength and durability for the attachment of pivot pin 320.

In some implementations, slider bearing block 325 may be formed with a cylindrical cavity that substantially conforms to the diameter of drive shaft 310, while permitting the drive shaft to slide or pass through the bearing block as may be required. Typically, the cylindrical cavity of the slider bearing block is devoid of any threading and may be designed with a relatively smooth internal surface to facilitate cooperation with drive shaft 310. Slider bearing block 325 may be utilized to facilitate the driving and retraction of drive shaft 310, and to provide structural support to the drive shaft as may be necessary or desired.

Hand lever 305 may be pivotally attached to base plate 15 using, for example, pivot pin 322 attached to link plate 315, and attached to pivot pin 320. Hand lever 305 is rotationally attached to the base plate at point 324. Link plate 315 is attached to enlarged end 308 of hand lever 305 by pivot pin 322, which is offset from point 324. In general, the driving and retracting of driver wedge 25 may be accomplished as follows. Similar to other embodiments, the driver block may be initially positioned in a retracted position. Retracting driver block 25 may be accomplished by placing the handle 305 in an open position, as indicated by handle 305(dashed lines). At this point, the door lock may be appropriately placed within the door gap.

Hand lever 305 may then be moved in a direction as indicated by arrow "a" forcing drive shaft 310 through slider bearing block 325, thereby driving driver wedge 25 underneath locking wedge 20. Retracting the driver wedge from its wedged position relative to the locking wedge may be accomplished by moving hand lever 305 back to the open position (shown in dashed lines). The retracted door lock may then be removed from its position within the door gap.

Figure 10:
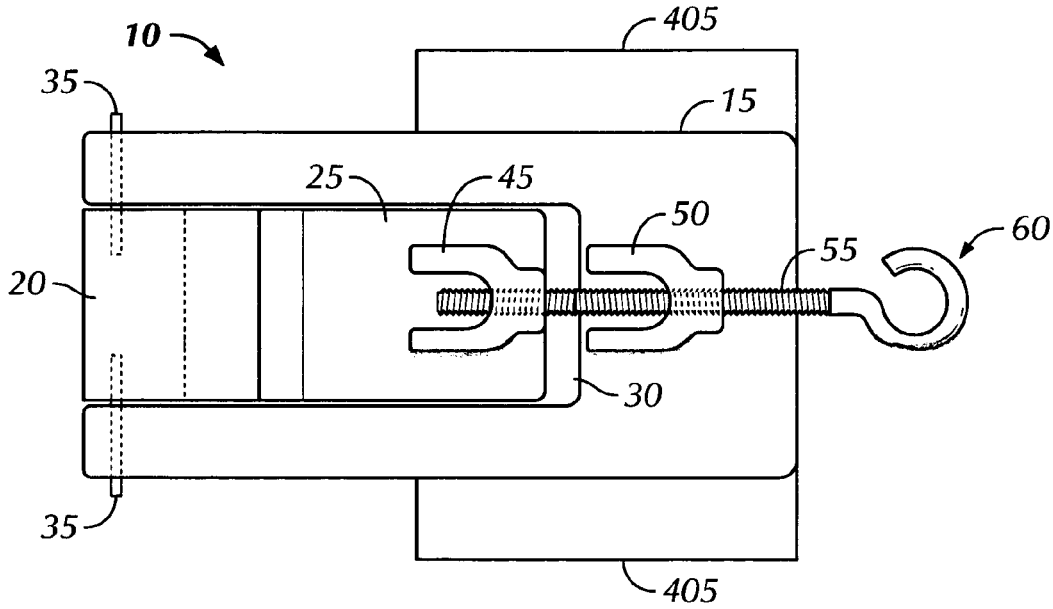
FIG. 10 is a top view of an alternative embodiment of the present invention optionally configured with an alarm device.

FIG. 10 is a top view of a door lock optionally configured with an alarm device. In particular, the door lock of FIGS. 1A and 1B is shown having an alarm device 405 attached to the underside of base plate 15. The alarm may include any suitable device that can detect movement or attempted forced entry, the specifics of which would be chosen by those skilled in the art. Typically, alarm 405 includes an audio speaker or other sound generating device that is activated upon the detection of some predetermined or user definable degree of movement. Although the alarm is shown configured with the hand screw implementation of the invention, it is to be understood that alarm 405 may be configured with any of the other embodiments.

An appropriately configured door lock of the invention may be utilized in a variety of applications including hotels, motels, residential homes, business, apartment homes, among others. Those who may also benefit from the use of the invention include people who desire enhanced security from unauthorized entry, which may include travelers, parents, roommates, and the like.

While the invention has been described in detail with reference to disclosed embodiments, various modifications within the scope and spirit of the invention will be apparent to those of working skill in this technological field. It is to be appreciated that features described with respect to one embodiment typically may be applied to other embodiments. Therefore, the invention properly is to be construed with reference to the claims.

What is claimed is:

1. A device for securing a door in a closed position, wherein the door when in the closed position has a gap between the door and the frame, the device comprising, a base plate formed in a U-shaped configuration, said U-shaped configuration defining a cut-out region in the base plate;

a locking wedge having a sloped bottom surface;

a driver wedge having a sloped top surface that slidably cooperates with the sloped bottom surface of the locking wedge; and means for driving the driving wedge in linear fashion underneath the locking wedge;

said cut-out region is sized to receive the locking and driver wedges and wherein the locking wedge is pivotally attached to the base plate, thereby permitting rotational movement of the locking wedge about a pivoting axis, and the linear movement of the driving wedge with respect to the locking wedge causes the locking wedge to secure the door in a closed position.

2. The device of claim 1, wherein the sloped bottom surface of the locking wedge slopes downward toward the driving wedge.

3. The device of claim 1, wherein said means for driving the driving wedge further comprises a threaded block mounted on the driver wedge, a threaded block mounted on the base plate, and a threaded shaft connecting the two threaded blocks.

4. The device of claim 3, wherein the threaded shaft has distal and proximal threaded regions having opposed thread directions.

5. A security device for a door wherein when the door is in a closed position there is a gap between the door edge and the door frame, the device comprising:

a base plate comprising a base member having spaced parallel legs extending therefrom;

a drive shaft guide on said base member;

a locking wedge member pivotably connected to said base plate between said legs;

a translatable driver wedge member shaped and configured to pivot said locking wedge member when moved toward and away from said locking wedge member;

a drive shaft extending through and being linearly movable with respect said drive shaft guide; and a block on said driver wedge member for receiving the distal end of said drive shaft, linear motion of said drive shaft causing movement of said driver wedge member with respect to said locking wedge member to selectively move said locking wedge between the locking configuration for forcefully engaging the door edge and the door frame, and the released configuration for enabling the device to be selectively inserted into and removed from the gap.

6. The device of claim 5, wherein the locking wedge member pivots with respect to the base plate about a pivot pin, said pivot pin being disposed in pin cavities formed near the parallel legs of the base plate.

7. The device of claim 5, wherein the locking wedge further comprises a sloped top surface and a sloped bottom surface.

8. The device of claim 5, wherein the driver wedge is constructed from two distinct driver wedge components which are pivotably attached to each other.

9. The device of claim 8, wherein the driver wedge comprises a driver plate and a further driver wedge pivotably coupled by a pivot.

10. The device of claim 5, further comprising a protrusion plate affixed to either side of the base plate, the protrusion plate comprising a base and wings that enclose a portion of the edge of the door.

11. The device of claim 5, wherein the driving means further comprises, selected from the group consisting of an electric motor, hydraulic pump and hand-actuated lever.

12. The device of claim 11, wherein the electric motor operates in forward and reverse directions.

13. The device of claim 5, further comprising an alarm device on the base plate, said alarm signaling movement or attempted forced opening of the door.

* * * * *